US010948235B2

(12) United States Patent
Fornoff et al.

(10) Patent No.: US 10,948,235 B2
(45) Date of Patent: Mar. 16, 2021

(54) SINTERING FURNACE FOR COMPONENTS MADE OF SINTERED MATERIAL, IN PARTICULAR, DENTAL COMPONENTS

(71) Applicant: DENTSPLY SIRONA inc., York, PA (US)

(72) Inventors: Peter Fornoff, Reichelsheim (DE); Christian Schmidt, Bensheim (DE)

(73) Assignee: DENTSPLY SIRONA Inc., York, PA (US)

( * ) Notice: Subject to any disclaimer, the term of this patent is extended or adjusted under 35 U.S.C. 154(b) by 709 days.

(21) Appl. No.: 15/550,401

(22) PCT Filed: Feb. 12, 2016

(86) PCT No.: PCT/EP2016/052968
§ 371 (c)(1),
(2) Date: Aug. 11, 2017

(87) PCT Pub. No.: WO2016/128534
PCT Pub. Date: Aug. 18, 2016

(65) Prior Publication Data

US 2018/0051931 A1 Feb. 22, 2018

(30) Foreign Application Priority Data

Feb. 12, 2015 (DE) ..... 10 2015 202 600

(51) Int. Cl.
*F27B 17/02* (2006.01)
*F27B 5/14* (2006.01)
(Continued)

(52) U.S. Cl.
CPC ..... *F27B 17/025* (2013.01); *F27B 5/14* (2013.01); *F27B 17/0075* (2013.01);
(Continued)

(58) Field of Classification Search
CPC ..... F27D 99/0006; F27D 2099/0008–0031; F27B 5/14; F27B 17/0075; F27B 17/025; F27B 2005/143; F27B 2005/146
See application file for complete search history.

(56) References Cited

U.S. PATENT DOCUMENTS

2012/0037610 A1* 2/2012 Yoo ..... F27B 17/0041 219/420
2012/0118875 A1* 5/2012 Jussel ..... A61C 13/20 219/634
2013/0146580 A1* 6/2013 Saijo ..... F27B 5/14 219/388

FOREIGN PATENT DOCUMENTS

DE 19753895 A1 6/1999
EP 2101547 A1 9/2009
(Continued)

OTHER PUBLICATIONS

International Search Report; PCT/EP2016/052968; May 24, 2016 (completed); dated May 6, 2016.
(Continued)

*Primary Examiner* — Ibrahime A Abraham
*Assistant Examiner* — John J Norton
(74) *Attorney, Agent, or Firm* — Dentsply Sirona Inc.

(57) ABSTRACT

The invention relates to a sintering furnace for components made of a sintered material, in particular for dental components, comprising a furnace chamber having a chamber volume (VK) and a chamber inner surface (OK), wherein a heat-up device, a receiving space having a gross volume (VB) located in the chamber volume (VK) and delimited by the heat-up device, and a useful region having a useful volume (VN) located in the gross volume (VB), are disposed in the furnace chamber. The furnace chamber has an outer wall consisting of a plurality of walls having a wall portion to be opened for introduction into the receiving space of a
(Continued)

component to be sintered and having an object volume (VO). In the furnace chamber the heat-up device has a thermal radiator having a radiation field which radiator is disposed on at least one side of the receiving space. Said thermal radiator has a specific resistance of 0.1 $\Omega mm^2/m$ to 1,000,000 $\Omega mm^2/m$ and has a total surface, the maximum of which is three times the chamber inner surface (OK). With this sintering furnace a heat-up temperature of at least 1100° C. can be achieved within 5 minutes at a maximum power input of 1.5 kW.

16 Claims, 6 Drawing Sheets

(51) Int. Cl.

| | |
|---|---|
| ***F27D 11/02*** | (2006.01) |
| ***F27D 11/06*** | (2006.01) |
| ***F27D 99/00*** | (2010.01) |
| ***F27B 17/00*** | (2006.01) |
| ***F27D 11/08*** | (2006.01) |

(52) U.S. Cl.
CPC ..... *F27D 11/02* (2013.01); *F27D 11/06* (2013.01); *F27D 11/08* (2013.01); *F27D 99/0006* (2013.01); *F27D 2099/0008* (2013.01)

(56) References Cited

FOREIGN PATENT DOCUMENTS

| | | | |
|---|---|---|---|
| EP | 2495520 | A1 | 9/2012 |
| EP | 2551620 | A1 | 1/2013 |
| JP | H06347168 | A | 12/1994 |
| JP | H1033564 | A | 2/1998 |
| WO | 2012057829 | A2 | 5/2012 |

OTHER PUBLICATIONS

International Preliminary Report on Patentability; PCT/EP2016/052968; May 24, 2016 (completed); dated May 6, 2016.
Written Opinion of the International Searching Authority; PCT/EP2016/052968; May 24, 2016 (completed); dated May 6, 2016.

* cited by examiner

SINTERING FURNACE FOR COMPONENTS MADE OF SINTERED MATERIAL, IN PARTICULAR, DENTAL COMPONENTS

TECHNICAL FIELD

The invention relates to a sintering furnace for components made of sintered material—in particular, for dental components and, in particular, for components made of ceramic—comprising a furnace chamber having a chamber volume and a chamber inner surface, wherein a heating device, a receiving space having a gross volume located in the chamber volume and delimited by the heating device, and a useful region having a useful volume located in the gross volume are arranged in the furnace chamber, and wherein the furnace chamber has an outer wall consisting of several walls with a wall section to be opened in at least one of the walls for introducing a component to be sintered having an object volume into the receiving space.

BACKGROUND OF THE INVENTION

The material to be sintered is critical for the design of a sintering furnace. Basically metallic or ceramic molded bodies are sintered, which were pressed from a powder and were, possibly, further processed either directly or by milling or grinding after a sintering-on process. The material determines the necessary temperature profile. The size and quantity of the components determine the size of the furnace and also the temperature profile. The hotter the furnace needs to be, the thicker the insulation needs to be. The size of the furnace and of the components, and the desired heating rate determine the design of the heating system and the control behavior. The power supply also plays a role in this respect. Ultimately, predominantly the size and also the power supply available cause a dental furnace for a laboratory to differ from an industrial sintering furnace.

Heat treatment processes—particularly, the complete sintering of dental restorations from pre-sintered ceramics or metals using a sintering furnace—typically last between 60 minutes and several hours. The process by which a dental restoration is manufactured, which requires both preparatory and follow-up steps, is interrupted for lengthy periods by this time requirement of a single step. For example, the so-called speed sintering for zirconium oxide requires a minimum of 60 minutes.

The so-called super-speed sintering for zirconium oxide currently requires a minimum of only 15 minutes of process run-through time. This, however, requires that the sintering furnace—especially, due to its weight—is preheated to the intended holding temperature, which lasts from 30 to 75 minutes depending upon the available system voltage. Additionally, after preheating, the furnace must be loaded via an automatic loading sequence, so that special temperature profiles can be maintained, and the furnace does not cool down unnecessarily.

From WO 2012/057829 is known a method for quickly sintering ceramic materials. In a first embodiment, a water-cooled copper pipe forms a coil, which is connected to a high-frequency power supply unit. The coil surrounds a thermal radiator called a susceptor, in which the material to be sintered is located. In this case, the susceptor is heated, wherein the heated susceptor, as the thermal radiator, transfers the heat to the material to be sintered.

In a second embodiment, the coil is connected to a high-frequency power supply with a sufficiently high frequency and power outputto produce a plasma, which then heats up the material.

However, one drawback of the preheating and subsequent loading is that the furnace—especially, its insulation and its heating elements—are subjected to high thermal cyclical loading, which tends to reduce the service life of the device.

Therefore, the aim of the present invention consists in providing a sintering furnace that makes possible an appropriately short manufacturing time, without preheating of the sintering furnace and/or a special loading sequence being necessary.

SUMMARY OF THE INVENTION

This aim is achieved by a sintering furnace for components made of a sintering material—especially, for dental components and, especially, for components made of ceramic—which sintering furnace comprises a furnace chamber, which has a chamber volume and a chamber inner surface and in which a heating device, a receiving space, and a useful region are arranged. The receiving space occupies a gross volume located in the chamber volume and delimited by the heating device. The useful region has a useful volume and is located in the receiving space. The furnace chamber further comprises an outer wall consisting of several walls, having at least one wall section to be opened for introducing a component to be sintered into the receiving space. The heating device in the furnace chamber has at least one thermal radiator having a radiation field, which thermal radiator is arranged on at least one side of the receiving space and in the radiation field of which is arranged at least the useful volume of the useful region. The maximum possible distance of the component to be sintered to the radiator corresponds at most to the second largest dimension of the maximum useful volume.

The thermal radiator has a specific resistance of 0.1 $\Omega mm^2/m$ to 1,000,000 $\Omega mm^2/m$ and has a total surface area of a maximum of 3—preferably, 2.5—times the chamber inner surface area.

The furnace chamber, also called the combustion chamber, forms the part that receives and heats the component to be sintered, i.e., the core of the sintering furnace. The entire volume enclosed by the furnace chamber is designated as the chamber volume. The free space remaining between the heating device arranged in the furnace chamber can receive the component to be sintered and therefore is designated as the receiving space. The volume of the receiving space is derived essentially from the width and height remaining between the heating device and possibly the chamber walls, and is therefore designated as the gross volume.

Designated as the useful region is the region of the sintering furnace in which the temperature necessary or desired for the sintering process is reached by means of the heating device. The useful region is thus the region in which the radiation field generated by the thermal radiator has the required intensity and/or homogeneity for the sintering process, and in which the component is positioned for sintering. In this case, the component has an object volume. This useful region thus results, in essence, from the radiation field or the arrangement of the heating device and its emission characteristics, and can be correspondingly smaller than the gross volume. For a successful sintering process, the object volume of the object to be sintered should therefore be at most the size of the useful volume. On the other hand, for sintering processes that are as rapid and efficient as possible, the size of the useful volume should at most be the size of an upper estimate of the object volume to be sintered.

The total surface of the thermal radiator consists of the surface facing the useful volume, i.e., an inner side, and also of the surface facing the wall of the furnace chamber, i.e., an outer side, as well as of the surfaces for connecting the inner side and the outer side. In the case of a thermal radiator in the form of a ring, the total surface therefore consists of the inner shell surface, the outer shell surface, and the two end surfaces. In the case of a thermal radiator in the form of a closed hollow cylinder, the total surface is constituted by the outer surface and the inner surface.

The chamber inner surface is determined by the walls of the furnace chamber. In the case of a cylindrical furnace chamber, there are the bottom, the lid, and the shell surface, which together form the chamber inner surface. In a cuboidal furnace chamber, the six side walls form the chamber inner surface.

In an advantageous further development, a furnace that allows for sufficiently rapid heating of the component is provided for a thermal radiator with a total surface area in the range of 1.0 to 3 times the chamber inner surface area. A ratio of more than 1.3 has been proven particularly advantageous, since a quite sufficient heating is achieved in this case, even though the thermal radiator covers the furnace chamber only partially.

If the furnace is to be able to be used for sintering or heating objects of varied size, e.g., for sintering individual tooth crowns and also bridges, it can be advantageous to design the thermal radiator of the heating device to be mobile, so that the size of the receiving space, i.e., the gross volume, as well as, in particular, the size of the useful region, i.e., the useful volume, is adaptable to the size of the object.

However, the useful volume can also be reduced by making the useful region smaller and adapted to the object size. For example, with an insulated door insert, a part of the receiving space can be blocked out.

Through an optimally good utilization of the gross volume, i.e., a maximum possible useful volume in relation to the gross volume, the volume to be heated during the sintering process can be kept as small as possible, whereby rapid heating and, especially, forgoing a preheating process, is possible.

Dental objects typically are of sizes from only a few millimeters to centimeters, so that, accordingly, a useful volume in the centimeter range typically suffices. For individual tooth restorations to be sintered, such as crowns and caps, a useful volume of 20×20×20 $mm^3$ can, for example, be sufficient. For larger dental objects, such as bridges, a useful volume of 20×20×40 $mm^3$ can suffice. Correspondingly, the maximum possible distance of the component to be sintered from the radiator for a dental sintering furnace can, for example, be limited or secured to 20 mm.

Advantageously, the ratio of the useful volume to the chamber volume is from 1:50 to 1:1, and the ratio of the useful volume to the gross volume of the receiving space is from 1:20 to 1:1.

The chamber volume of the sintering furnace is advantageously between 50 $cm^3$ and 200 $cm^3$.

It is advantageous if the maximum total surface area of the radiator, and thus of the heating device, is about 400 $cm^2$.

The smaller the volumes and the smaller the mass that, overall, has to be heated, the more quickly a desired temperature can be reached in the furnace chamber or in the useful region, and the sintering process can be carried out successfully. For example, the chamber volume of the furnace chamber can be 60×60×45 $mm^3$, and the gross volume can be 25×35×60 $mm^3$. These specifications mean that the dimensions of the respective volume are 60 mm×60 mm×45 mm and 25 mm×35 mm×60 mm respectively.

Advantageously, the object volume can be a maximum of 20×20×40 $mm^3$. The dimensions are then 20 mm×20 mm×40 mm.

The ratio of the useful volume for the component to be sintered to the object volume of the component to be sintered can be from 1, 500:1 to 1:1.

The smaller the difference between the useful volume of the useful region and the object volume of the component to be sintered, the more quickly and energy-efficiently the sintering process can be carried out for the component. Based upon the optimal dimensioning with a maximum power consumption of 1.5 kW, a heating temperature of at least 1,100° C. can therefore be achieved with this sintering furnace within 5 minutes.

Advantageously, the heating element or the thermal radiator can be heated resistively or inductively.

Inductive heating elements or resistance heating elements represent simple embodiment variants of a heating element, which constitutes a thermal radiator, of a sintering furnace.

Advantageously, the thermal radiator of the heating device consists of graphite, $MoSi_2$, SiC, or glassy carbon, since these materials have a specific resistance in the range of 0.1 $\Omega mm^2/m$ to 1,000,000 $\Omega mm^2/m$.

Advantageously, the outer wall has a chamber inner wall that is impermeable and/or reflective to the radiation field, which chamber inner wall especially has a reflective coating or is designed as a reflector.

By means of a reflective coating, the intensity of the radiation field of the thermal radiator in the useful region, i.e., within the useful volume, can be increased. If the thermal radiator is arranged only on one side of the receiving space, then, for example by means of a reflecting coating placed oppositely or a reflector placed oppositely, a more homogeneous and/or more intense radiation field can be achieved in the useful region.

Advantageously, the heating device has a heating element as a thermal radiator with a heating rate in the useful region of at least 200 K/min at 20° C.

Advantageously, the useful volume can be a maximum of 20×20×40 $mm^3$, and the dimensions of the useful volume are at most 20 mm×20 mm×40 mm.

According to a further development, the thermal radiator can be designed as a crucible.

BRIEF DESCRIPTION OF THE DRAWINGS

The invention will be explained with reference to the drawings. Shown are.

DETAILED DESCRIPTION OF THE INVENTION

Figure 1:
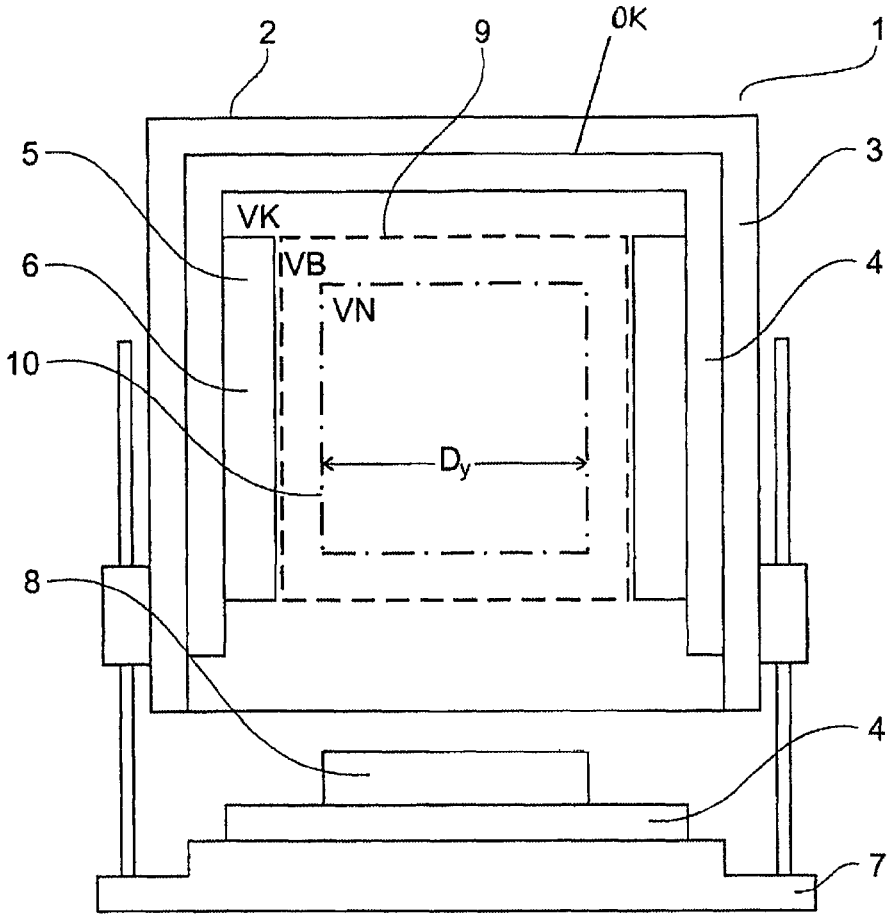
FIG. 1 a part of a sintering furnace according to the invention for components made of a sintered material—especially, for dental components.

FIG. 1 shows a part of a sintering furnace 1, which has a furnace chamber 2 with a chamber volume VK, the walls 3 of which are provided with an insulation 4 for shielding the hot furnace chamber 2 against the environment. The chamber volume VK is in this case between 50 $cm^3$ and 200 $cm^3$. For heating the furnace chamber 2, a heating device 5 with two thermal radiators 6 is arranged in the furnace chamber 2. The furnace chamber 2 has a wall section 7 to be opened for introducing a component 15 to be sintered into the furnace chamber 2, which wall section in this case is the lower wall section, i.e., the bottom of the furnace chamber 2. The component 15 to be sintered has a volume of at least 10×10×10 $mm^3$. The maximum size of the component 15 is 20×20×40 $mm^3$.

The bottom 7 likewise has an insulation 4, on which a base 8 for the components 15 to be sintered is placed, which base is also designated as support 8. As support 8, cross pieces or a crucible or vertically-placed pins made of ceramic or high-melting metal, onto which the component 15 is placed, are also to be considered.

As a result of the heating device 5 or the thermal radiator 6, which, in FIG. 1, is, for example, arranged on two sides of the furnace chamber 2, there is, within furnace chamber 2, a free volume, which is smaller than the chamber volume VK and which, in FIG. 1, is indicated with a dashed line and is designated as the gross volume VB. The space that this gross volume VB occupies is the receiving space 9, into which an object 15, with object volume VO. to be sintered can be introduced. In this case, the heating device 5 has a total surface area that is at most 2.5 times a chamber inner surface area OK. The total surface area of the heating device 5 is in this case not larger than 400 $cm^2$. The material of the heating device 5 has a specific resistance of between 0.1 $\Omega mm^2/m$ to 1,000,000 $\Omega mm^2/m$, wherein the heating device 5 can, for example, consist of graphite, $MoSi_2$, SiC, or glassy carbon.

Using the thermal radiator 6 of the heating device 5, the receiving space 9 is heated, wherein at least a part of the gross volume VB of the receiving space 9 is heated in a sufficiently strong and uniform fashion. This region is designated as the useful region 10, and the volume as the useful volume VN. In FIG. 1, the useful region 10 is schematically depicted with a dot-dashed line, and a second largest dimension of the useful region 10 is drawn in as D. The size and position of the useful region 10 is determined essentially by the emission characteristics, i.e., the radiation field 13, and the arrangement of the radiator 6, wherein a placement of the radiators 6 on at least one side of the receiving space 9 ensures that the useful region 10 lies within the receiving space 9.

Figure 2A:
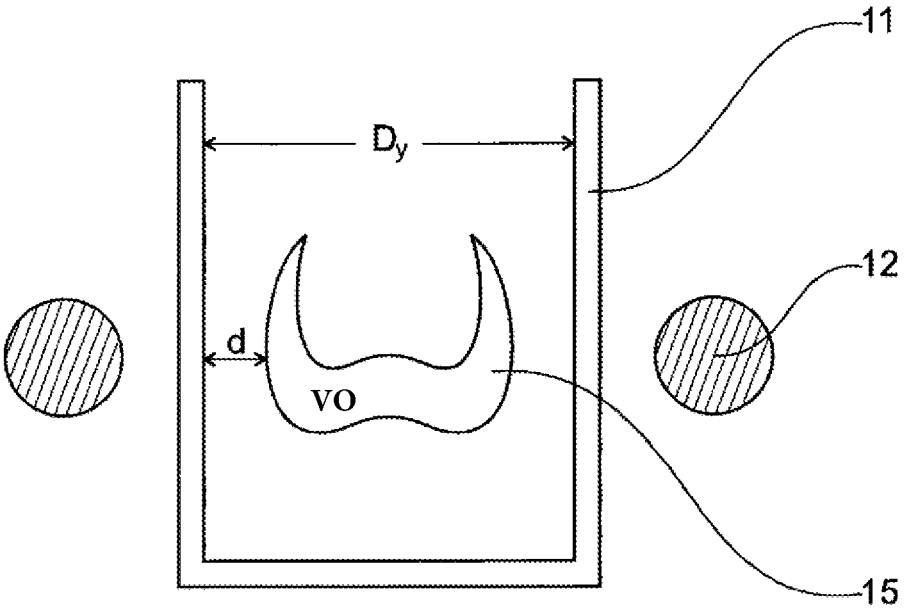
FIGS. 2A, B an inductively heatable heating device with a thermal radiator consisting of a crucible and coil.
Figure 2B:
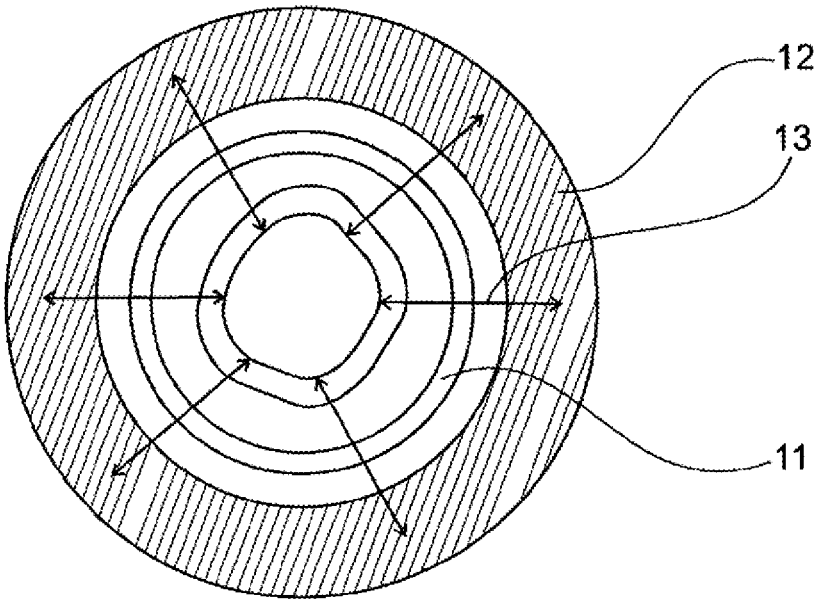

The object 15 to be sintered can, for example, be resistively or inductively heated. In FIGS. 2A and 2B, for example, an inductively heated thermal radiator 6 is depicted as heating device 5. The thermal radiator 6 is designed as a crucible 11—made, for example, of graphite, $MoSi_2$, SiC, or glassy carbon—with at least one circumferential coil 12 for inductive heating, wherein the emission of the crucible 11, i.e., the thermal radiation 13, is indicated by arrows. In this example, the receiving space 9 is formed by the inner space of the crucible. The useful region 10 likewise is located in the inner space of the crucible 11, wherein the ratio of the usable volume VN of the usable region 10 to the gross volume VB of the receiving space 9 is 1:1.

Even though not shown in FIG. 2A, a retort, such as a bell jar, can be provided, which is arranged in the crucible and surrounds the component 15.

The component 15 to be sintered is arranged in the inner space of crucible 11, in the receiving space 9 that coincides with the useful region 13. The distance of the object to the thermal radiator 6, i.e., to the crucible 11 in this case, is designated as d.

Figure 3:
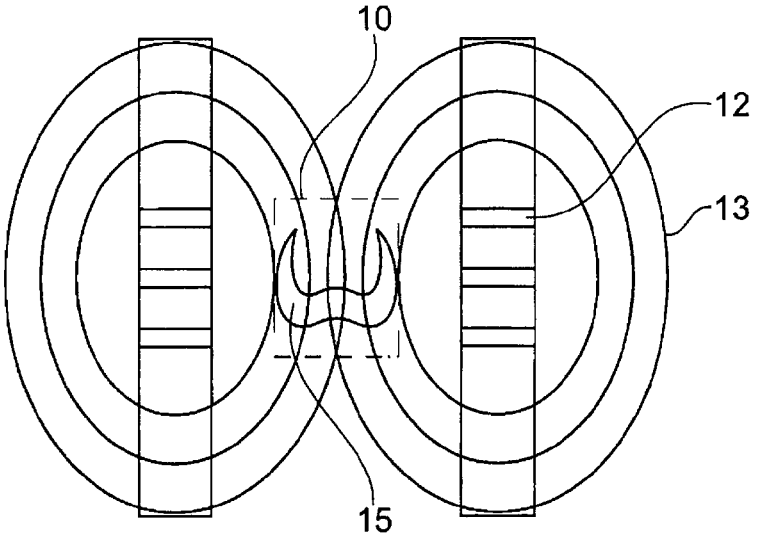
FIG. 3 a plate-shaped, inductively-heatable thermal radiator having an integrated coil.

FIG. 3 shows a thermal radiator 6 formed from two plate-shaped elements, which is heated by means of integrated coils 12. The receiving space 9 correspondingly is located between the two plate-shaped elements. FIG. 3 furthermore shows the radiation field 13 of the thermal radiator 6 with lines. This accordingly results in a useful region 10 that is arranged in the receiving space 9 and that covers an area as homogeneous as possible of the radiation field 13 with high intensity.

Figure 4A:
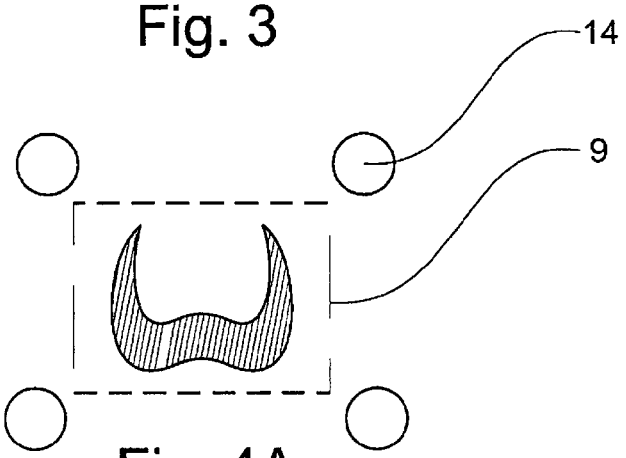
FIGS. 4A, B resistively-heatable heating devices with thermal radiators consisting of rod-shaped heating elements.
Figure 4B:
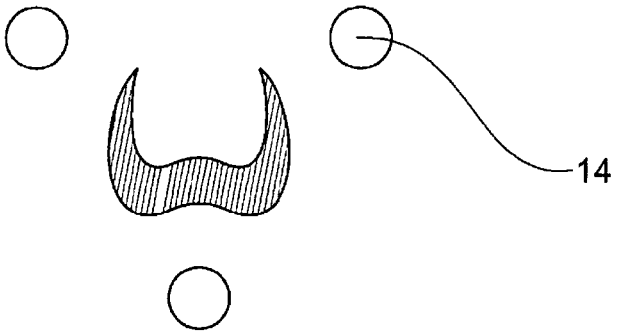

The thermal radiators 6 depicted in FIGS. 4A and 4B consist of three or four rod-shaped, resistance heating elements 14 respectively.

Figure 8:
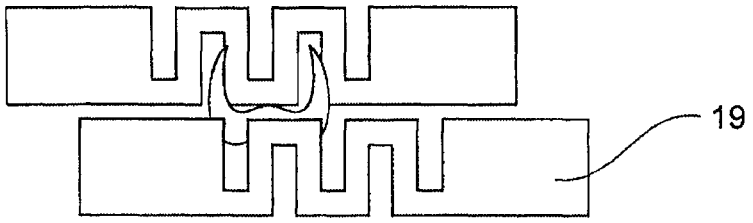
FIG. 8 a thermal radiator consisting of planar heating elements.
Figure 5:
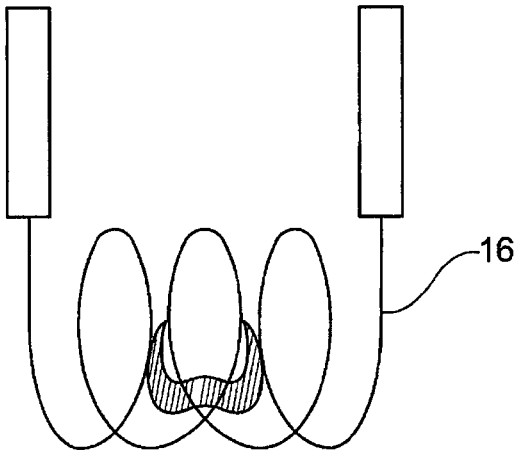
FIG. 5 a heating spiral as a resistance heating element.
Figure 6:
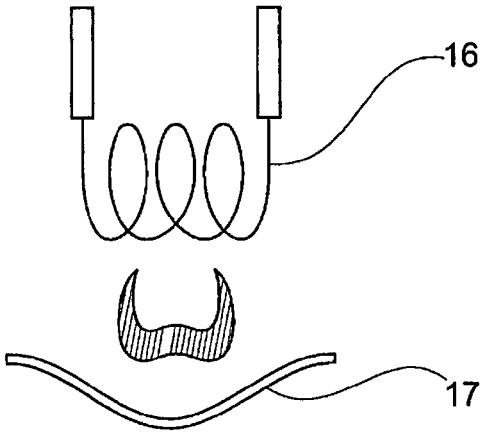
FIG. 6 a thermal radiator consisting of a heating spiral and reflector.
Figure 7:
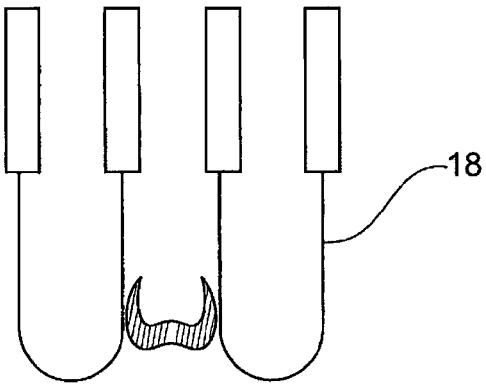
FIG. 7 a thermal radiator consisting of U-shaped heating elements.

Additional variants of resistive thermal radiators 6 and arrangements are shown in FIGS. 5 through 8. The thermal radiator 6 shown in FIG. 5 is designed as a heating spiral 16, wherein the receiving space 9 and the useful region 10 are cylindrical and arranged within the heating spiral. In FIG. 6, the thermal radiator 6 is a combination of a radiant heater—in this case, a heating spiral 16 and a reflector 17—wherein the receiving space 9 and the useful region 10 are located between the heating spiral 16 and the reflector 17. FIG. 7 shows a thermal radiator consisting of two U-shaped heating elements 18 having a receiving space 9 arranged between the two U-shaped heating elements 18. In FIG. 8, a thermal radiator 6 consisting of two planar heating elements 19 is depicted. These typically have a planar emission pattern, as a result of which the useful region occupies an especially large part of the receiving space 9 located between the planar heating elements 19.

With a maximum power consumption of 1.5 kW, a heating temperature of at least 1,100° C. can be achieved with the sintering furnace 1 according to the invention within 5 minutes.

The ratio of the radiator surface area to the surface area of the chamber inner surface is specified to be at most 2.5. In specifying this value, it has been assumed that the chamber inner surface area also corresponded to the surface area of the useful volume. The considerations regarding this maximum ratio were substantially based upon an annular thermal radiator as it is formed by the shell surface of the crucible of FIG. 2A.

In rod-shaped thermal radiators as an embodiment according to, for example, FIGS. 4*a*, 4*b*, 7, it comes about that the surface of such thermal radiators can be smaller than the surface of the furnace chamber or than the surface of the useful volume. In a furnace design with rod elements as thermal radiators, the chamber inner surface is considerably larger than the useful volume, as a result of which the surface area ratios are virtually zero. If the surface of the useful volume is selected instead, a reasonable minimum ratio of the radiator surface area to the surface area of the useful volume of 0.4 results.

The useful volume is defined as the limit within which a safe burning process is possible. It has geometric dimensions which can, for example, be specified by means of the length, width, and height (l×w×h). If the size of the useful volume is increased, the specified ratio to the total surface area of the thermal radiator decreases. Such a furnace can, however, be operated continuously only at a lower power.

It is also conceivable that the dimensions of the thermal radiator protrude beyond the boundaries of the furnace chamber, to arrive approximately at a ratio above 2.5. With an upper limit of the ratio of 3, a sufficient compromise between the additional technical economical effort to be made and the advantage of the invention is afforded here. The lower limit of 1 limits the invention in terms of power output, compared with furnaces with smaller thermal radiators.

Figure 9:
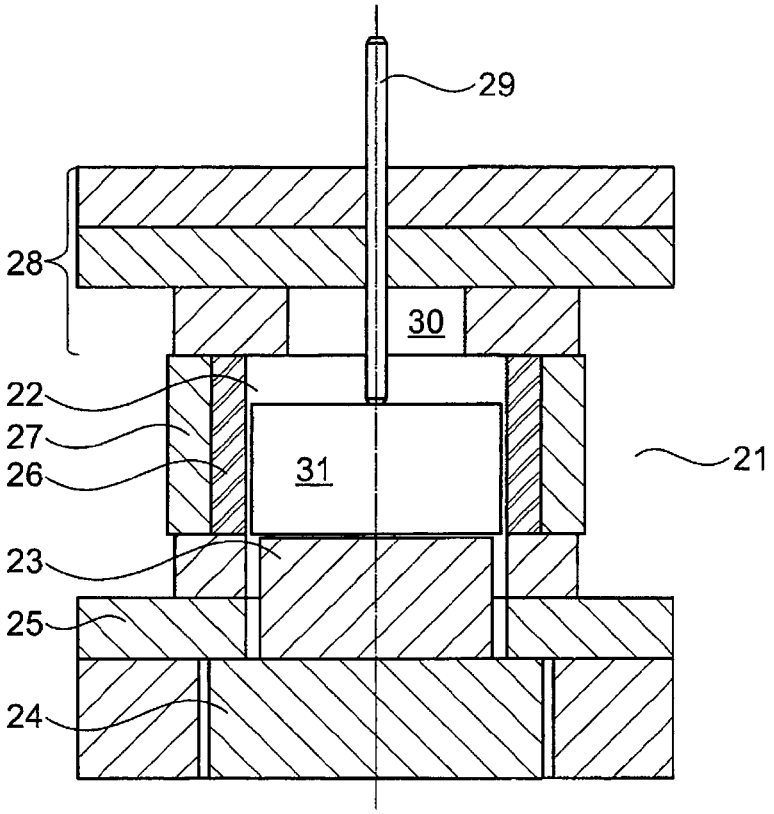
FIGS. 9-16 different arrangements of the thermal radiator and the useful volume in the furnace chamber.

FIGS. 9-16 show different arrangements of the thermal radiator and the useful volume in the furnace chamber. For example, FIG. 9 shows a schematic design of a furnace 21 with a furnace chamber 22, which is delimited at the bottom, at least partially, by an inner and an outer doorstone 23, 24—also called upper and lower doorstones. The doorstone is surrounded laterally by the lower wall section of the furnace chamber, which wall section is designed with multiple parts in the present case, viz., with three layers.

On the lower wall section 25 rests an annular thermal radiator 26, which is arranged in the furnace chamber 22 and which, again, is surrounded by an annular insulating wall section 27. For reasons of clarity, the coils located further outside for inductively heating the thermal radiator 26 are not shown.

Above the annular wall section 27, the furnace chamber 22 is delimited by the upper wall section 28, which is designed with multiple layers like the lower wall section 25. A thermal element 29 protrudes through the upper wall section 28 into the furnace chamber 22 and thereby also penetrates to some extent into the inner space 30 enclosed by the thermal radiator 26, and thus delimits a useful volume 31 arranged in the inner space 30, since the component arranged on the doorstone 23 and not shown must not come into contact with the thermal element 30.

The surface of the furnace chamber 22 is in this case formed by the surface of the wall section 27 facing the furnace chamber, and by the top side of the doorstone 23 and the bottom side of the upper wall section 28. The annular space around the thermal element, as well as the gap between the first door element and the lower wall element, are disregarded.

Figure 10A:
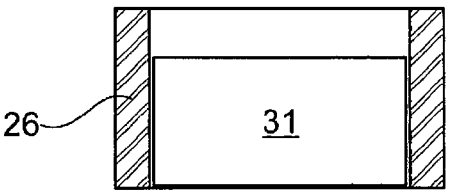
Figure 10B:
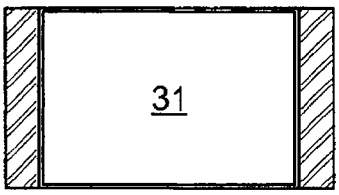

FIG. 10A illustrates in detail the arrangement of the restricted useful region 31 with respect to the radiator 26 of FIG. 9, in order to compare it to a useful region 31 illustrated in FIG. 10B. The ratio of the total surface area of the thermal radiator and the furnace chamber does not change, even if the ratio of the total surface area of the thermal radiator to the surface area of the useful volume decreases from FIG. 10A to FIG. 10B.

Figure 11:
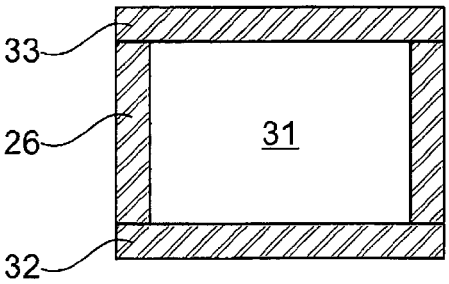

FIG. 11 shows a thermal radiator 26, which additionally comprises a bottom 32 and a lid 33, as a result of which the total surface area of the thermal radiator 26 compared to the total surface area of the thermal radiator 26 of FIG. 9 is increased. The useful volume 31 corresponds to that of FIG. 10B.

Figure 12:
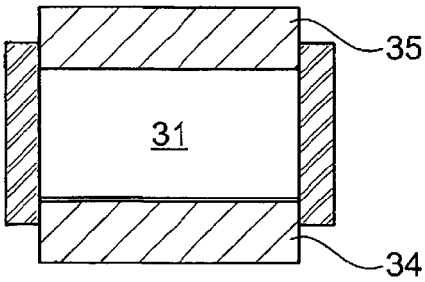

In FIG. 12, the useful volume 31 is reduced by insulating wall sections 34, 35, wherein the thermal radiator itself remains unchanged compared to FIGS. 9 and 10A, 10B. The surface area of the furnace chamber thus also decreases, and the ratio of the total surface area of the thermal radiator and the furnace chamber increases.

Figure 13:
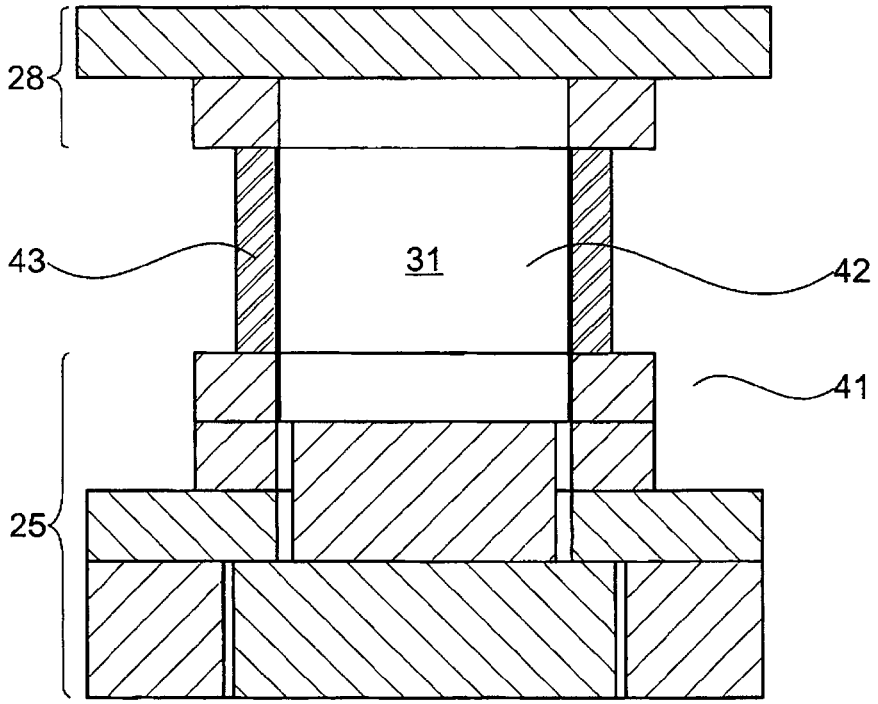

FIG. 13 shows a furnace 41 with a furnace chamber 42, which, at the top and at the bottom, goes beyond the inner space 31 of the thermal radiator 43 and continues into the upper and into the lower wall sections 28, 25 so that the useful region is enlarged. The ratio of the total surface area of the thermal radiator and the furnace chamber is decreased as a result.

Figure 14:
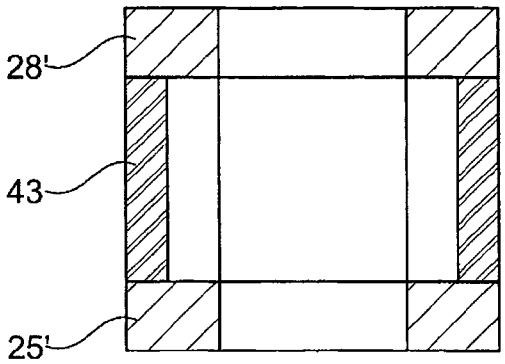

In FIG. 14, the useful region is further reduced, compared to the useful region of FIG. 13, by the upper and the lower wall sections 28', 25' no longer having the same inner diameter as the thermal radiator 43. The total surface area of the thermal radiator remains the same, but the surface area of the furnace chamber is reduced, compared to that of FIG. 13.

Figure 15:
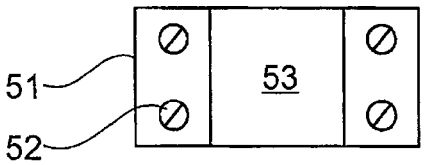

In FIG. 15, several cylindrical thermal radiators 52 (4 thermal radiators are illustrated in this case) are arranged in pairs at a distance from one another in a given furnace chamber 51, which radiators extend into the drawing plane. The useful region is located between a pair of radiators. The ratio of the total surface area of the thermal radiators 52 to the surface area of the furnace chamber 51 is smaller in comparison to the arrangement of FIGS. 9-14.

Figure 16:
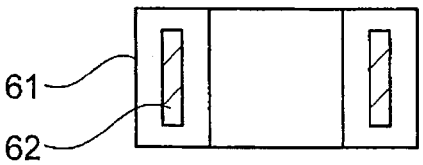

This also applies if elongated planar heating elements 62 are used in a furnace chamber 61, as illustrated in FIG. 16, instead of cylindrical thermal radiators.

The thermal radiators of FIGS. 15 and 16 can also be resistive radiators, which are heated as a result of the electrical resistance when an electrical current passes through them.

The invention claimed is:

1. A sintering furnace for components made of a sintered material comprising:

a furnace chamber having a chamber volume (VK) and a chamber inner surface area(OK), wherein a heating device, a receiving space having a gross volume (VB) located in the chamber volume (VK) and delimited by the heating device, and a useful region having a useful volume (VN) located in the gross volume (VB) are arranged in the furnace chamber, and wherein the furnace chamber has an outer wall including a plurality of walls having at least one wall section to be opened for introducing a component to be sintered into the receiving space, wherein the heating device in the furnace chamber contains at least one thermal radiator, which has a specific resistance ranging from 0.1 $\Omega mm^2/m$ to 1,000,000 $\Omega mm^2/m$ and a total surface area that is at between 1 and 3 times the chamber inner surface area (OK).

2. The sintering furnace according to claim 1, wherein the chamber volume (VK) of the sintering furnace is between 50 $cm^3$ and 200 $cm^3$.

3. The sintering furnace according to claim 1, wherein the maximum total surface area of the thermal radiator is not larger than 400 $cm^2$.

4. The sintering furnace according to claim 1, wherein the object volume (VO) is at most 20×20×40 $mm^3$.

5. The sintering furnace according to claim 1, wherein the thermal radiator is heated in an inductive fashion.

6. The sintering furnace according to claim 1, wherein the heating device consists of graphite, $MoSi_2$, SiC, or glassy carbon.

7. The sintering furnace according to claim 1, wherein the outer wall has a chamber inner wall that is impermeable and/or reflective to the radiation field.

8. The sintering furnace according to claim 7, wherein the chamber inner wall has a reflective coating.

9. The sintering furnace according to claim 7, wherein the chamber inner wall is designed as a reflector.

10. The sintering furnace according to claim 1, wherein the thermal radiator is heated in a resistive fashion.

11. The sintering furnace according to claim 1, wherein the thermal radiator of the heating device has a heating rate in the useful region of at least 200 K/min at 20° C.

12. The sintering furnace according to claim 1, wherein the useful volume (VN) is at most 20×20×40 $mm^3$ and that the dimensions of the useful volume (VN) are at most 20 mm×20 mm×40 mm.

13. The sintering furnace according to claim 1, wherein the thermal radiator is designed as a crucible (11).

14. The sintering furnace according to claim 1, wherein the sintered material is for one or more dental components.

15. The sintering furnace according to claim 12, wherein the one or more dental components are made of ceramic.

16. The sintering furnace according to claim 1, wherein the total surface area is at most 2.5 times the chamber inner surface area (OK).

* * * * *